US012152578B2

(12) United States Patent
Patel et al.

(10) Patent No.: US 12,152,578 B2
(45) Date of Patent: Nov. 26, 2024

(54) PUMP SYSTEM WITH TUBE GUIDES

(71) Applicant: Fenwal, Inc., Lake Zurich, IL (US)

(72) Inventors: Amit J. Patel, Algonquin, IL (US); Samantha M. Planas, Wauconda, IL (US); Fletcher C. Belt, Bull Valley, IL (US)

(73) Assignee: Fenwal, Inc., Lake Zurich (IL)

( * ) Notice: Subject to any disclaimer, the term of this patent is extended or adjusted under 35 U.S.C. 154(b) by 30 days.

(21) Appl. No.: 17/245,282

(22) Filed: Apr. 30, 2021

(65) Prior Publication Data

US 2021/0372391 A1 Dec. 2, 2021

Related U.S. Application Data

(60) Provisional application No. 63/031,091, filed on May 28, 2020.

(51) Int. Cl.
*F04B 43/12* (2006.01)

(52) U.S. Cl.
CPC ..... *F04B 43/12* (2013.01)

(58) Field of Classification Search
CPC .. F04B 43/12; F04B 43/0081; F04B 43/1261; F04B 43/1253
See application file for complete search history.

(56) References Cited

U.S. PATENT DOCUMENTS 3,502,034 A * 3/1970 Pickup ..... F04B 43/1215 417/477.13
4,184,815 A 1/1980 Casson et al.
4,796,590 A * 1/1989 Degobert ..... F02D 41/1451 123/703
5,213,483 A * 5/1993 Flaherty ..... F04B 43/0072 417/474

(Continued)

FOREIGN PATENT DOCUMENTS

EP 0825345 A2 2/1998
EP 1048848 A1 11/2000

(Continued)

OTHER PUBLICATIONS

Extended European Search Report Dated Oct. 1, 2021 for European Application No. 21176081.4.

(Continued)

*Primary Examiner* — Nathan C Zollinger
(74) *Attorney, Agent, or Firm* — Cook Alex Ltd.

(57) ABSTRACT

A peristaltic pump system includes tubing with first and second tube collars. The system also includes a rotary peristaltic pump with a tube channel having first and second ends, a first tube guide disposed at the first end and a second tube guide disposed at the second end. The first and second tube guides each include a passage with an inner diameter that is larger than the outer diameter of the tubing. The first tube guide has an unrestricted shoulder configured to abut the first tube collar in an installation state, and the second (Continued)

tube guide has an unrestricted shoulder configured to abut the second tube collar in the installation state. The first tube guide passage is disposed between its shoulder and the first end of the tube channel, while the second tube guide passage is disposed between its shoulder and the second end of the tube channel.

19 Claims, 4 Drawing Sheets

(56) References Cited

U.S. PATENT DOCUMENTS 5,326,236 A * 7/1994 Kramer ..... F04B 43/123 417/474
5,533,877 A * 7/1996 Friedmann ..... F04B 43/1253 417/477.1
5,971,726 A * 10/1999 Yoshida ..... F04B 43/1253 417/477.1
6,041,709 A * 3/2000 Wells ..... B41F 31/08 417/477.3
6,494,692 B1 * 12/2002 Green ..... F04B 43/0072 417/477.1
2006/0083644 A1 4/2006 Zumbrum et al.
2009/0214365 A1 * 8/2009 Norman ..... A61M 5/14232 417/474
2013/0315763 A1 11/2013 Neoh et al.

FOREIGN PATENT DOCUMENTS

EP 2397695 A1 12/2011
WO WO 2006/008465 1/2006
WO WO 2007/038364 4/2007

OTHER PUBLICATIONS

Fresenius Kabi AG, Autopheresis-C System, brochure, 8 pages (Mar. 2013).
Fresenius Kabi USA LLC, Lovor Automated Cell Processing System, brochure, 4 pages (Apr. 2019).
Watson-Marlow Pumps Group, Watson-Marlow 120 cased pumps, manual, 36 pages (Jul. 2010).
Watson-Marlow Pumps Group, 120F, 120S and 120U pumps with 102R, 114DV, 400D1, 400DM2 and 400DM3 pumpheads, brochure, 6 pages (2018).

* cited by examiner

PUMP SYSTEM WITH TUBE GUIDES

CROSS-REFERENCE TO RELATED APPLICATIONS

This application claims the benefit of U.S. Provisional Patent App. No. 63/031,091, filed May 28, 2020, which is expressly incorporated herein by reference in its entirety.

TECHNICAL FIELD

The present disclosure is generally directed to a peristaltic pump system. More particularly, the present disclosure is directed to a peristaltic pump system having improved tube guides and tubing.

BACKGROUND

In a conventional rotary peristaltic pump, pump rollers act against a section of tubing disposed through the pump to move fluid through the tubing. The tubing must be fixed at least at the inlet of the pump, because otherwise the rotary motion of the pump rollers would feed the tubing through the pump. Where the pump is a bi-directional pump, the tubing must be fixed at both ends of the pump, because either end may function as the inlet.

Conventionally, the tubing is fixed relative to the pump using a tube guide that compresses or squeezes the tubing. For example, a tube guide or holder may have a circular opening with an inner diameter smaller than the outer diameter of the tubing.

Care must be taken in the design of the tube guide. The tube guide must compress the tube sufficiently to keep the tubing fixed in the tube guide, while limiting blockage of the fluid flow through the tubing caused by compression of the tubing. Consequently, the inner diameter of the tube guide is usually only slightly smaller than the outer diameter of the tubing.

Typically, the tubing is disposed through the pump by the user, and then is fixed in place at the ends by disposing the tubing in the tube guides. Because the tubing that is disposed through the pump and fixed in the tube guides is merely a section of a longer length of tubing, the specific amount of tubing fixed between the tube guides can and will vary. The user's judgement may result in the section of tubing disposed between the guides to be stretched (or "tight"), causing the inner diameter of the tubing to narrow and impacting flow rate. Alternatively, the user may fix a section of tubing between the guides that can move relative to the tube guides (or "loose"), leading to kinking and twisting of the tubing as the tube rollers of the pump act on the tubing in the pump.

Kinking can occur within the pumping area, or at a junction just prior to the tube guide on the outlet end of the pump. Kinking is to be particularly avoided because in addition to altering the flow rates, it may also lead to tubing failures and leaking. Kinks in the tubing can also lead to high shear rates in the fluid being pumped, and this can in turn lead to damage in the fluid (e.g., damage to the cells in the fluid). For example, when pumping blood, kinks in the tubing can lead to hemolysis.

In addition, when the section of tubing is loaded into the pump, the user must orient the tubing properly. Differences in tubing orientation can lead to twist in the tubing that can lead to differences in flow rate, like the stretching or kinking that can occur because of improper length of the section of tubing between the tube guides.

It would be desirable to provide a pump system that overcame, at least in part, the disadvantages of conventional rotary peristaltic pump systems.

SUMMARY

In an aspect, a peristaltic pump system includes a length of tubing having first and second ends. The tubing has an outer diameter, a first tube collar fixedly attached to the tubing at a first position between the first and second ends and extending outwardly of the outer diameter, and a second tube collar fixedly attached to the tubing at a second position spaced from the first position between the first and second ends and extending outwardly of the outer diameter. The system also includes a rotary peristaltic pump with an arcuate tube channel having a first end and a second end, the length of tubing disposed in the arcuate tube channel, and a rotor configured to contact the length of tubing disposed in the arcuate tube channel to move fluid through the length of tubing. The system further includes a first tube guide disposed at the first end of the tube channel and a second tube guide disposed at the second end of the tube channel. The first and second tube guides each include a passage therethrough with an inner diameter that is larger than the outer diameter of the tubing, and an opening in communication with the passage through which the length of tubing is disposed into the passage. The first tube guide has an unrestricted shoulder configured to abut the first tube collar with the length of tubing in the arcuate tube channel in an installation state, and the second tube guide has an unrestricted shoulder configured to abut the second tube collar with the length of tubing in the arcuate tube channel in the installation state. The passage of the first tube guide is disposed between the unrestricted shoulder of the first tube guide and the first end of the arcuate tube channel, and the passage of the second tube guide is disposed between the unrestricted shoulder of the second tube guide and the second end of the arcuate tube channel.

DETAILED DESCRIPTION

A more detailed description of the systems and methods in accordance with the present disclosure is set forth below. It should be understood that the description below of specific devices and methods is intended to be exemplary, and not exhaustive of all possible variations or applications. Thus, the scope of the disclosure is not intended to be limiting, and should be understood to encompass variations or embodiments that would occur to persons of ordinary skill.

Figure 1:
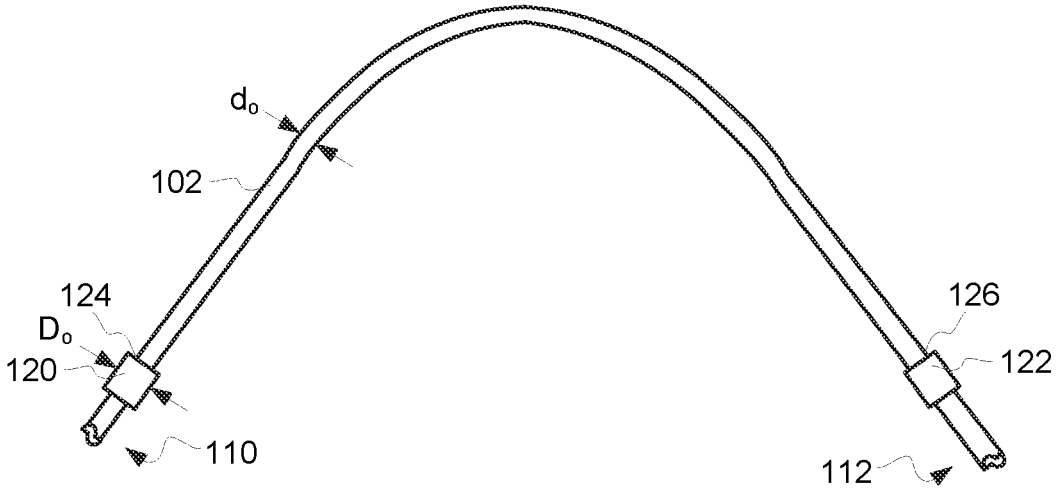
FIG. 1 is a side view of an embodiment of a length of tubing having first and second tube collars fixedly attached thereto.
Figure 2:
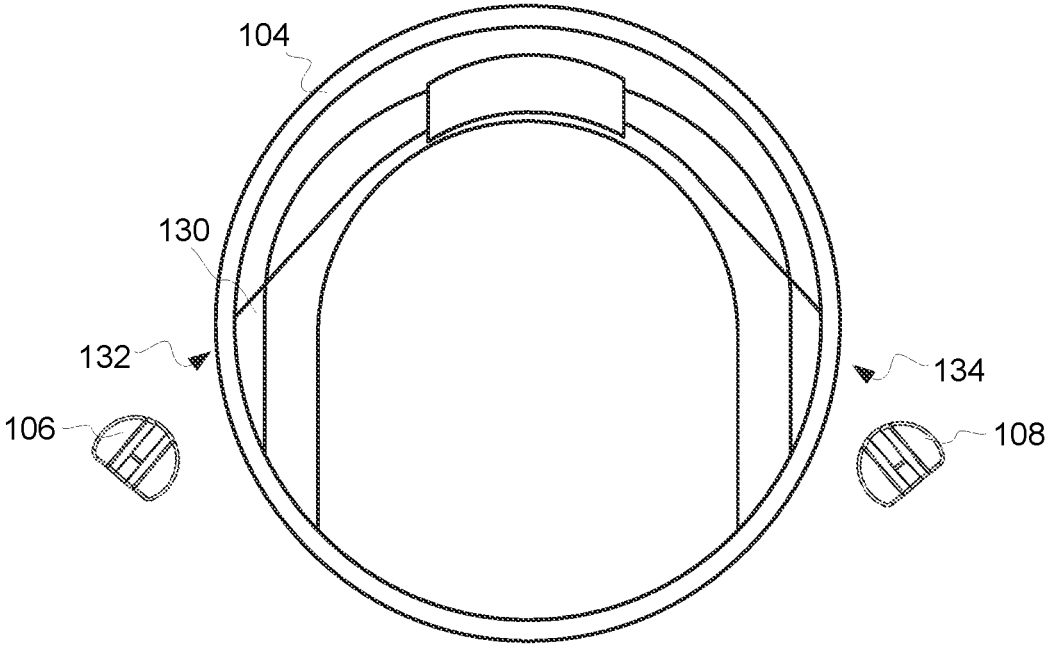
FIG. 2 is a side view of an embodiment of a rotary peristaltic pump with first and second tube guides disposed at either end of the pump before the length of tubing of FIG. 1 is disposed in the pump and tube guides.
Figure 3:
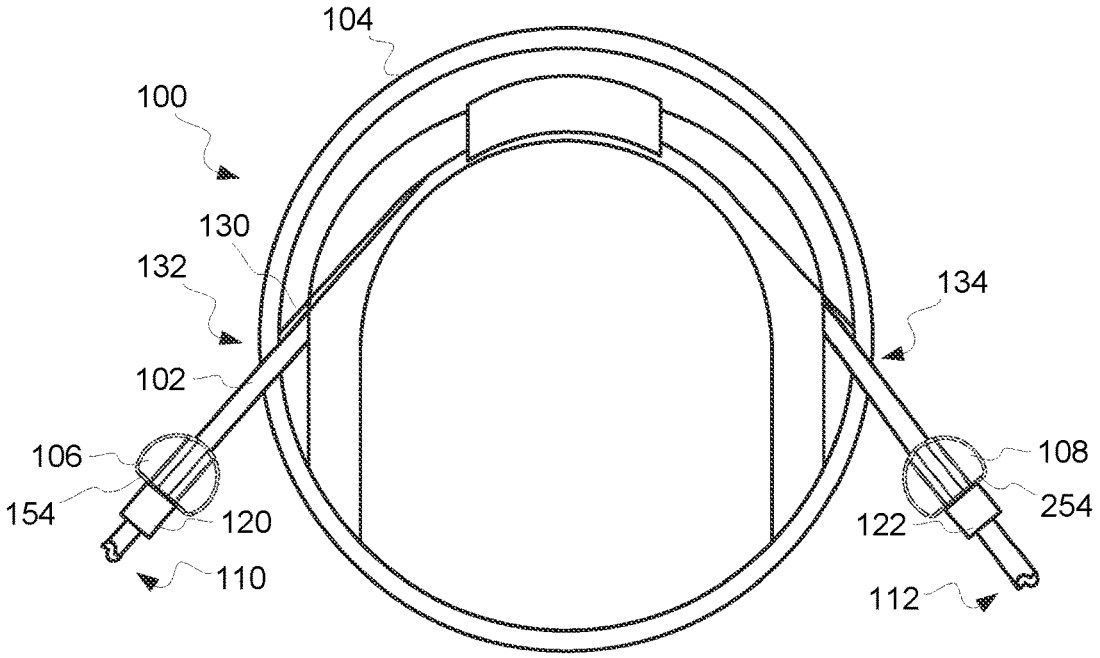
FIG. 3 is a side view of the rotary peristaltic pump and tube guides of FIG. 2 after the length of tubing of FIG. 1 is disposed through the pump and tube guides.

FIGS. 1-3 illustrate an embodiment of a peristaltic pump system 100. The system 100 includes a length of tubing 102, a rotary peristaltic pump 104, and first and second tube guides 106, 108.

As seen in FIGS. 1 and 3, the length of tubing 102 has first and second ends 110, 112. The tubing 102 also has an outer diameter, with a first tube collar 120 and a second tube collar 122 fixedly attached to the tubing 102. For example, the collars 120, 122 may be attached to the tubing 102 using cyclohexanone solvent bonding. The first tube collar 120 is attached at a first position 124 between the first and second ends 110, 112. The second tube collar 122 is attached to the tubing at a second position 126 spaced from the first position 124 between the first and second ends 110, 112. Both the first and second tube collars 120, 122 extend outwardly of the outer diameter of the tubing 102.

As seen in FIGS. 2 and 3, the rotary peristaltic pump 104 has an arcuate tube channel 130 with a first end 132 and a second end 134. The length of tubing 102 is disposed in the arcuate tube channel 130, and a rotor of the pump 104 contacts the length of tubing 102 disposed in the arcuate tube channel 130 to move fluid through the length of tubing 102. The first tube guide 106 is disposed at the first end 132 of the tube channel 130, and the second tube guide 108 is disposed at the second end 134 of the tube channel 130.

As best seen in FIGS. 5-7 and 8-10, the first and second tube guides 106, 108 each include a passage 150, 250 therethrough with an inner diameter ($d_i$) that is larger than the outer diameter ($d_o$) of the tubing 102 (compare FIG. 1 with FIGS. 7 and 10), and an opening 152, 252 in communication with the passage 150, 250 through which the length of tubing 102 is disposed into the passage 150, 250 (see FIGS. 5, 6 and 8, 9). The first tube guide 106 has an unrestricted shoulder or surface 154 configured to abut the first tube collar 120 with the length of tubing 102 in the arcuate tube channel 130 in an installation state (see FIG. 3). Similarly, the second tube guide 108 has an unrestricted shoulder or surface 254 configured to abut the second tube collar 122 with the length of tubing 102 in the arcuate tube channel 130 in the installation state.

The unrestricted shoulder 154, 254 is a structure that abuts the tube collar 120, 122 to limit axial motion toward the pump 104, but does not limit or prevent motion of the tube collar 122, 124 axially away from the shoulder 154, 254 (and thus away from the pump 104) or rotationally relative to the shoulder 154, 254. As a consequence, the shoulder 154, 254 does not prevent the tubing 102 attached to the collar 120, 122 from moving axially away from the shoulder 154, 254 such that it is no longer abutting the shoulder 154, 254. See, e.g., FIG. 4. Further, the shoulder 154, 254 does not prevent the tubing 102 from rotating about its own axis.

Figure 7:
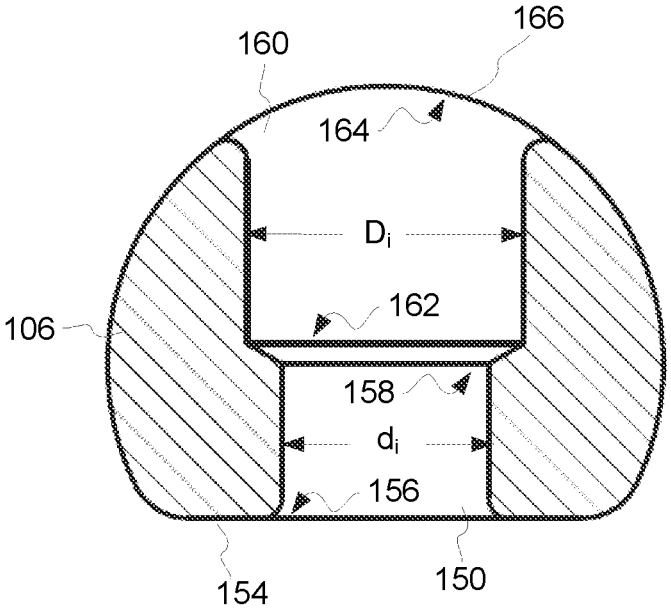
FIG. 7 is a cross-sectional view of the tube guide of FIG. 5 taken along line 7-7 in FIG. 6.
Figure 8:
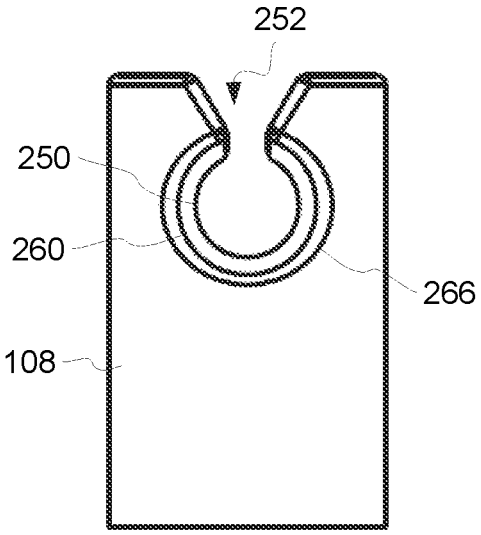
FIG. 8 is a side view of an embodiment of the second tube guide or holder.
Figure 9:
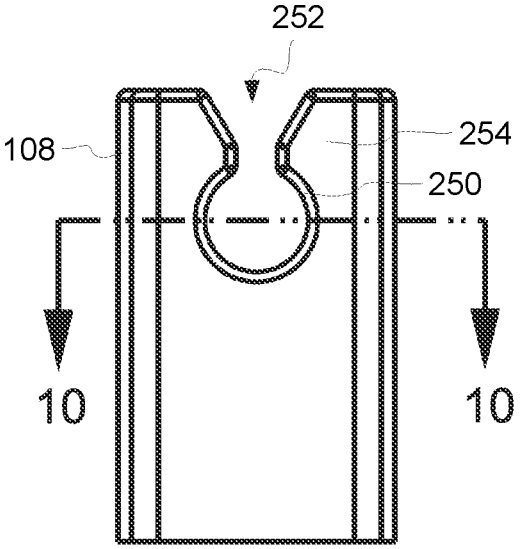
FIG. 9 is an opposite side view of the tube guide of FIG. 8.
Figure 10:
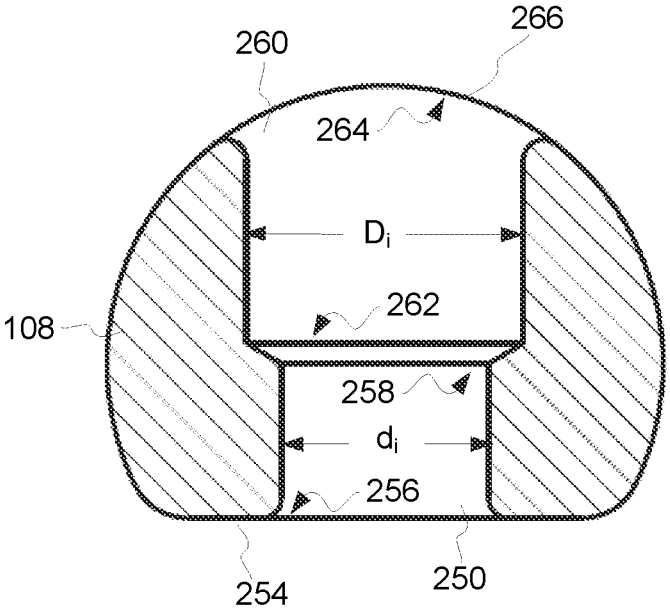
FIG. 10 is a cross-sectional view of the tube guide of FIG. 8 taken along line 10-10 in FIG. 9.

The passage 150 of the first tube guide 106 is disposed between the unrestricted shoulder 154 of the first tube guide 106 and the first end 132 of the arcuate tube channel 130 (compare FIG. 7 and FIG. 3). Further, the passage 250 of the second tube guide 108 is disposed between the unrestricted shoulder 254 of the second tube guide 108 and the second end 134 of the arcuate tube channel 130 (compare FIG. 10 and FIG. 3).

During installation of the tubing 102, the section of the tubing 102 between the first and second collars 120, 122 is disposed into the arcuate tube channel 130. The ends 110, 112 of the tubing 102 may be pulled slightly so that the tubing 102 may be inserted into the tube guides 106, 108, with the collars 120, 122 disposed axially outwardly from the shoulders 154, 254. The tension applied to the end or ends 110, 112 may be released, at which point the collars 120, 122 may move axially in the direction of the shoulders 154, 254. See FIG. 3. Because of the comparative distances between the collars 120, 122 and the guides 106, 108, and in particular the shoulders 154, 254, the section of tubing 102 between the first and second collars 120, 122 may be slightly in tension even after the tubing is permitted to relax.

Figure 4:
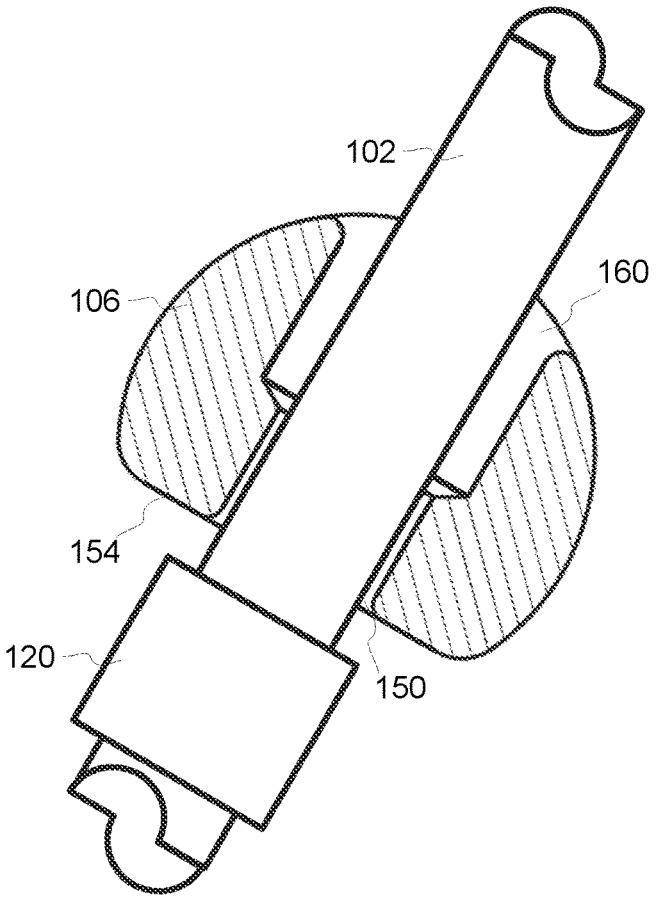
FIG. 4 is an enlarged, partially cross-sectional view of the tubing and first tube collar of FIG. 1 and the associated first tube guide of FIG. 2, with the stretching of the tubing caused by the operation of the pump causing displacement of the tube collar relative to the respective tube guide.
Figure 5:
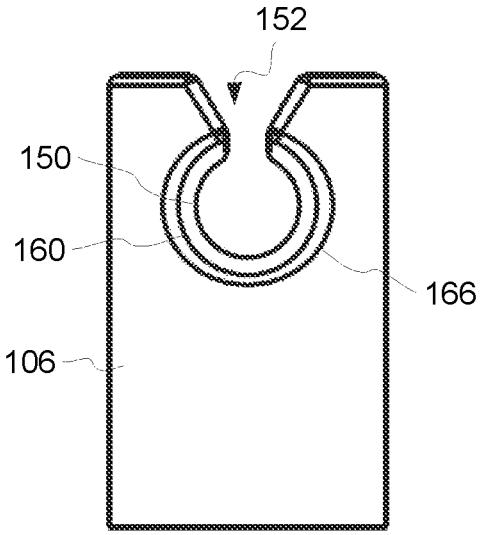
FIG. 5 is a side view of an embodiment of the first tube guide or holder.
Figure 6:
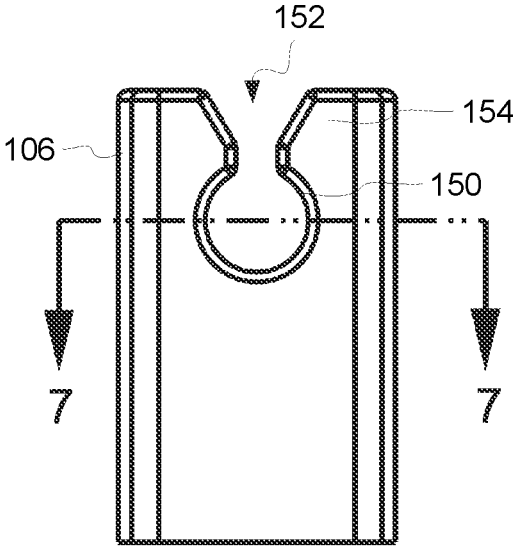
FIG. 6 is an opposite side view of the tube guide of FIG. 5.

During operation of the pump 104, the tubing 102 may rotate relative to the guides 106, 108 to prevent or relieve any twist from developing in the tubing 102. Furthermore, if the tubing 102 experiences stretching in a portion of the tubing 102, the collar 120, 122 may move axially away from the shoulder 154, 254 to limit or prevent kinking in the tubing 102. For example, FIG. 4 illustrates a state where the collar 120 has moved axially away from the shoulder 154 to limit or prevent kinking at the end 110 of the tubing as a consequence of the operation of the pump 104 on the tubing 102, with a gap formed between the collar 120 and the shoulder 154.

Having thus explained the structure, installation and operation of the system in general terms, the details of the structure of the system 100 are now discussed with reference first to FIGS. 1-3.

As mentioned above, the pump 104 is a rotary peristaltic pump, such as may be included as part of an AURORA® or AURORA Xi® automated cell processing system, both of which are available from Fresenius Kabi USA, Lake Zurich, Illinois. More particularly, peristaltic pump 104 may be a bidirectional peristaltic pump.

FIG. 1 illustrates an embodiment of the length of tubing 102 with first and second tube collars 120, 122. As illustrated, the first tube collar 120 and the second tube collar 122 each comprise an annular collar disposed about the tubing 102. The first and second annular collars 120, 122 each have an outer diameter ($D_o$) that is larger than the outer diameter ($d_o$) of the tubing 102.

According to this embodiment, the annular collars 120, 122 are continuous and regular about a periphery of an outer surface of the tubing 102. That is, the collar 120, 122 extends entirely about the circumference of the tubing 102, and the shape of the collar 120, 122 is uniform or identical about the circumference. In particular, both the first and second tube collars 120, 122 are cylindrical.

This should not be taken as suggesting that the collar 120, 122 could not be discontinuous or irregular according to other embodiments. For example, one or both of the collars 120, 122 could have an outer edge of varying distance from the center of the collar, like a gear with many "teeth" or only a few "teeth". As another example, one of both of the collars 120, 122 could have a C-shape, and thus be discontinuous about the circumference of the tubing 102.

However, because the intent is for the collar 120, 122 to be free to rotate relative to the shoulder 154, 254, the collar should not be shaped such that a portion of the collar may incidentally interact with, for example, the opening 152, 252 to the passage 150, 250 to prevent the collar from rotating freely relative to the shoulder 154, 254. Consequently, it is particularly advantageous for the collar to be continuous and uniform, such as in the form of a cylinder in the illustrated embodiment.

As a consequence of the use of a continuous and regular tube collar 120, 122, the unrestricted shoulder 154, 254 of the first tube guide 106 and the second tube guide 108 may be discontinuous, e.g., where the opening 152, 252 is in communication with the passage 150, 250. Still, the unrestricted shoulder 154 of the first tube guide 106 may be continuous except where the opening 152 is in communication with the passage 150 of the first tube guide 106, and the unrestricted shoulder 254 of the second tube guide 108 may be continuous except where the opening 252 is in communication with the passage 250 of the second tube guide 108. More particularly, the unrestricted shoulder 154 of the first tube guide 106 may be disposed about at least 80% of a periphery of the passage 150 of the first tube guide 106, and the unrestricted shoulder 254 of the second tube guide 108 may be disposed about at least 80% of a periphery of the passage 150 of the second tube guide 108, for example.

As general proposition, one of the first tube collar 120 and the unrestricted shoulder 154 of the first tube guide 106 should be continuous and the other of the first tube collar 120 and the unrestricted shoulder 154 of the first tube guide 106 may be discontinuous. In a similar fashion, one of the second tube collar 122 and the unrestricted shoulder 254 of the second tube guide 108 should be continuous and the other of the second tube collar 122 and the unrestricted shoulder 254 of the second tube guide 108 may be discontinuous. To permit the shoulder 154, 254 to be continuous, while still permitting the tubing 102 to be introduced into the tube guide 106, 108, a gate may be used in conjunction with the shoulder 154, 254, which gate is moved into place over the opening 152, 252 when the tubing 102 is in position.

According to embodiments such as the one illustrated in the Figures, the first and second tube collars 120, 122 may be identical in structure. According to other embodiments, the tube collars 120, 122 may have a different shape, for example one may be longer in an axial direction along the tubing than the other collar. The relationship between the passages 150, 250, shoulders 154, 254 and tube collars 120, 122 as recited above will remain the same even in such an embodiment.

According to the illustrated embodiment, the distance between the tube collars 120, 122 is selected such that when the collars 120, 122 are installed, the length of tubing 102 between the tube collars 120, 122 is placed in a state of tension. To achieve this tension, a distance between the unrestricted shoulder 154 of the first tube guide 106 and the unrestricted shoulder 254 of the second tube guide 108 along a path through the arcuate tube channel 130 is greater than a distance between the first tube collar 120 and the second tube collar 122 in a relaxed state. For the reasons provided above, the degree of tension is selected such that the tubing 102 resists kinking without interfering substantially with the flow therethrough. According to an alternative embodiment, the distance between the tube collars may be selected such that the tubing 102 is not in tension.

Additionally, according to the illustrated embodiments, the passage 150 of the first tube guide 106 has a first end 156 and a second end 158, and the shoulder 154 of the first tube guide 106 is disposed at the first end 156 of the passage 150 of the first tube guide 106. Similarly, the passage 250 of the second tube guide 108 has a first end 256 and a second end 258, and the shoulder 254 of the second tube guide 108 is disposed at the first end 256 of the passage 250 of the second tube guide 108. Finally, a distance between the second ends 158, 258 of the passages 150, 250 of the first and second tube guides 106, 108 is smaller than a distance between the first ends 156, 256 of the passages 150, 250 of the first and second tube guides 106, 108 (compare FIG. 3 with FIGS. 7 and 10).

As to the embodiments of the tube guides as illustrated in FIGS. 5-10, the first tube guide 106 may include a second passage 160 with an inner diameter ($D_i$) that is larger than the inner diameter ($d_i$) of the passage 150, the second passage 160 having a first end 162 and a second end 164, the first end 162 of the second passage 160 connected to the second end 158 of the passage 150 and the second end 164 of the second passage 160 defining an unrestricted axial opening 166. According to this embodiment, the second tube guide 108 also may include a second passage 260 with an inner diameter that is larger than the inner diameter of the passage 250, the second passage 260 having a first end 262 and a second end 264, the first end 262 of the second passage 260 connected to the second end 258 of the passage 250 and the second end 264 of the second passage 260 defining an unrestricted axial opening 266. The interfaces between the passages 150, 250 and the second passages 160, 260 are lead-in or funnel features that ensure that, even if the tube guide 106, 108 is slightly rotated, the tubing 102 will be able to slide through the tube guide 106, 108 without pinching.

The system 100 according to the disclosed embodiments provides certain advantages relative to conventional pump systems using conventional tube guides or holders. Because the tube guides or holders are loose on the tubing (i.e., the inner diameter of the passage is greater than the outer diameter of the tubing), the tubing can be stretched such that the tube collar is well past the tube holder during loading. When the user releases the tubing after loading, the tubing will contract until the tube collars abut the tube guides. This may prevent flow rate inaccuracies caused by operator over-stretching of the tubing during loading when disposing tubing in a standard tubing guide. Further, any increased tube length caused by insufficient tubing line tension at loading (e.g., tubing collars too far apart) or stretching of the tubing during operation will not be trapped between the guide and the pump, causing kinking. Instead, the tube is free to move relative to the guide, creating a gap between the tube collar and the tube guide, limiting or eliminating the risk of kinking. In particular, see FIG. 4. Additionally, because the tubing is free to rotate, the tube damage because of twisting or coiling can be limited or prevented.

Thus, an improved pump system has been disclosed, in conjunction with an improved tubing set or kit and improved tube guides or holders. The description provided above, and the other aspects provided below, are intended for illustrative purposes, and are not intended to limit the scope of the disclosure to any particular method, system, apparatus or device described herein.

Other Aspects

Aspect 1. A peristaltic pump system comprising:

a length of tubing having first and second ends, the tubing having an outer diameter, a first tube collar fixedly attached to the tubing at a first position between the first and second ends and extending outwardly of the outer diameter, and a second tube collar fixedly attached to the tubing at a second position spaced from the first position between the first and second ends and extending outwardly of the outer diameter;

a rotary peristaltic pump with an arcuate tube channel having a first end and a second end, the length of tubing disposed in the arcuate tube channel, and a rotor configured to contact the length of tubing disposed in the arcuate tube channel to move fluid through the length of tubing; and a first tube guide disposed at the first end of the tube channel and a second tube guide disposed at the second end of the tube channel, the first and second tube guides each comprising a passage therethrough with an inner diameter that is larger than the outer diameter of the tubing, and an opening in communication with the passage through which the length of tubing is disposed into the passage, the first tube guide having an unrestricted shoulder configured to abut the first tube collar with the length of tubing in the arcuate tube channel in an installation state, and the second tube guide having an unrestricted shoulder configured to abut the second tube collar with the length of tubing in the arcuate tube channel in the installation state, and the passage of the first tube guide disposed between the unrestricted shoulder of the first tube guide and the first end of the arcuate tube channel, and the passage of the second tube guide disposed between the unrestricted shoulder of the second tube guide and the second end of the arcuate tube channel.

Aspect 2. The pump system according to aspect 1, wherein:

the first tube guide comprises another passage with an inner diameter that is larger than the inner diameter of the passage, the another passage having a first end connected to the passage and a second end, and the second tube guide comprises another passage with an inner diameter that is larger than the inner diameter of the passage, the another passage having a first end connected to the passage and a second end.

Aspect 3. The pump system according to aspect 1 or 2, wherein a distance between the unrestricted shoulder of the first tube guide and the unrestricted shoulder of the second tube guide along a path through the arcuate tube channel is greater than a distance between the first tube collar and the second tube collar in a relaxed state.

Aspect 4. The pump system according to any one of aspects 1 to 3, wherein the unrestricted shoulder of the first tube guide is continuous except where the opening is in communication with the passage of the first tube guide, and the unrestricted shoulder of the second tube guide is continuous except where the opening is in communication with the passage of the second tube guide.

Aspect 5. The pump system according to aspect 4, wherein the unrestricted shoulder of the first tube guide is disposed about at least 80% of a periphery of the passage of the first tube guide, and unrestricted shoulder of the second tube guide is disposed about at least 80% of a periphery of the passage of the second tube guide.

Aspect 6. The pump system according to any one of aspects 1 to 5, wherein the first tube collar and the second tube collar each comprise an annular collar disposed about the tubing, the annular collar having an outer diameter that is larger than the outer diameter of the tubing.

Aspect 7. The pump system according to aspect 6, wherein the annular collar is continuous and regular about a periphery of an outer surface of the tubing.

Aspect 8.The pump system according to aspect 7, wherein the annular collar is a cylindrical collar.

Aspect 9. The pump system according to any one of aspects 1to 3, wherein one of the first tube collar and the unrestricted shoulder of the first tube guide is continuous and the other of the first tube collar and the unrestricted shoulder of the first tube guide is discontinuous, and one of the second tube collar and the unrestricted shoulder of the second tube guide is continuous and the other of the second tube collar and the unrestricted shoulder of the second tube guide is discontinuous.

Aspect 10. The pump system according to any one of aspects 1 to 9, wherein:

the passage of the first tube guide has a first end and a second end, and the unrestricted shoulder of the first tube guide is disposed at the first end of the passage of the first tube guide, the passage of the second tube guide has a first end and a second end, and the unrestricted shoulder of the second tube guide is disposed at the first end of the passage of the second tube guide, and a distance between the second ends of the passages of the first and second tube guides being smaller than a distance between the first ends of the passages of the first and second tube guides.

Aspect 11. The pump system according to any one of aspects 1 to 10, wherein the first tube guide is identical to the second tube guide, and the first tube collar is identical to the second tube collar.

Aspect 12. The pump system according to any one of aspects 1 to 11, wherein the peristaltic pump is a bidirectional peristaltic pump.

The invention claimed is:

1. A peristaltic pump system comprising:

a length of tubing having first and second ends, the tubing having an outer diameter, a first tube collar fixedly attached to the tubing at a first position between the first and second ends and extending outwardly of the outer diameter, and a second tube collar fixedly attached to the tubing at a second position spaced from the first position between the first and second ends and extending outwardly of the outer diameter;

a rotary peristaltic pump with an arcuate tube channel having a first end and a second end, the length of tubing disposed in the arcuate tube channel, and a rotor configured to contact the length of tubing disposed in the arcuate tube channel to move fluid through the length of tubing; and a first tube guide disposed at the first end of the tube channel and a second tube guide disposed at the second end of the tube channel wherein each tube guide is disposed loose on the tubing and a separate detached structure from the rotary peristaltic pump, the first and second tube guides each comprising a passage therethrough with an inner diameter that is larger than the outer diameter of the tubing, and an opening in communication with the passage through which the length of tubing is disposed into the passage, the first tube guide having an unrestricted shoulder configured to abut the first tube collar with the length of tubing in the arcuate tube channel in an installation state, and the second tube guide having an unrestricted shoulder configured to abut the second tube collar with the length of tubing in the arcuate tube channel in the installation state, wherein the tube guides limit axial movement of the collars and tubing toward the pump but allows for axial movement away from the pump in the installation state, and the passage of the first tube guide disposed between the unrestricted shoulder of the first tube guide and the first end of the arcuate tube channel, and the passage of the second tube guide disposed between the unrestricted shoulder of the second tube guide and the second end of the arcuate tube channel.

2. The pump system according to claim 1, wherein:

the first tube guide comprises another passage with an inner diameter that is larger than the inner diameter of the first tube guide passage, the another passage having a first end connected of the first tube guide passage and a second end, and the second tube guide comprises another passage with an inner diameter that is larger than the inner diameter of the first tube guide passage, the another passage having a first end connected of the first tube guide passage and a second end.

3. The pump system according to claim 1, wherein a distance between the unrestricted shoulder of the first tube guide and the unrestricted shoulder of the second tube guide along a path through the arcuate tube channel is greater than a distance between the first tube collar and the second tube collar in a relaxed state.

4. The pump system according to claim 1, wherein the unrestricted shoulder of the first tube guide is continuous except where the opening is in communication with the passage of the first tube guide, and the unrestricted shoulder of the second tube guide is continuous except where the opening is in communication with the passage of the second tube guide.

5. The pump system according to claim 4, wherein the unrestricted shoulder of the first tube guide is disposed about at least 80% of a periphery of the passage of the first tube guide, and the unrestricted shoulder of the second tube guide is disposed about at least 80% of a periphery of the passage of the second tube guide.

6. The pump system according to claim 1, wherein the first tube collar and the second tube collar each comprise an annular collar disposed about the tubing, the annular collar having an outer diameter that is larger than the outer diameter of the tubing.

7. The pump system according to claim 6, wherein the annular collar is continuous and regular about a periphery of an outer surface of the tubing.

8. The pump system according to claim 7, wherein the annular collar is a cylindrical collar.

9. The pump system according to claim 1, wherein one of the first tube collar and the unrestricted shoulder of the first tube guide is continuous and the other of the first tube collar and the unrestricted shoulder of the first tube guide is discontinuous, and one of the second tube collar and the unrestricted shoulder of the second tube guide is continuous and the other of the second tube collar and the unrestricted shoulder of the second tube guide is discontinuous.

10. The pump system according to claim 1, wherein:

the passage of the first tube guide has a first end and a second end, and the unrestricted shoulder of the first tube guide is disposed at the first end of the passage of the first tube guide, the passage of the second tube guide has a first end and a second end, and the unrestricted shoulder of the second tube guide is disposed at the first end of the passage of the second tube guide, and a distance between the second ends of the passages of the first and second tube guides being smaller than a distance between the first ends of the passages of the first and second tube guides.

11. The pump system according to claim 1, wherein the first tube guide is identical to the second tube guide, and the first tube collar is identical to the second tube collar.

12. The pump system according to claim 1, wherein the rotary peristaltic pump is a bidirectional peristaltic pump.

13. The pump system according to claim 1, wherein the first and second tube guides only restrict axial movement of the first and second tube collars toward the pump.

14. The pump system according to claim 1, wherein the first and second tube guides are not fixedly attached to any other component of the system.

15. A peristaltic pump system comprising:

a length of tubing having first and second ends, the tubing having an outer diameter, a first tube collar fixedly attached to the tubing at a first position between the first and second ends and extending outwardly of the outer diameter, and a second tube collar fixedly attached to the tubing at a second position spaced from the first position between the first and second ends and extending outwardly of the outer diameter;

a rotary peristaltic pump with an arcuate tube channel having a first end and a second end, the length of tubing disposed in the arcuate tube channel, and a rotor configured to contact the length of tubing disposed in the arcuate tube channel to move fluid through the length of tubing; and a first tube guide disposed at the first end of the tube channel and a second tube guide disposed at the second end of the tube channel, the first and second tube guides are each a separate detached structure from the rotary peristaltic pump;

the first and second tube guides each comprising a passage therethrough with an inner diameter that is larger than the outer diameter of the tubing, and an opening in communication with the passage through which the length of tubing is disposed into the passage, the first tube guide having an unrestricted shoulder configured to abut the first tube collar with the length of tubing in the arcuate tube channel in an installation state, and the second tube guide having an unrestricted shoulder configured to abut the second tube collar with the length of tubing in the arcuate tube channel in the installation state, and the passage of the first tube guide disposed between the unrestricted shoulder of the first tube guide and the first end of the arcuate tube channel, and the passage of the second tube guide disposed between the unrestricted shoulder of the second tube guide and the second end of the arcuate tube channel.

16. The pump system of claim 15, wherein the tube guide is disposed loose on the tubing.

17. The pump system of claim 15, wherein the tube guides limit axial movement of the collars and tubing toward the pump but allow for axial movement away from the pump in the installation state.

18. The pump system of claim 1, wherein the first and second tube guides are standalone structures.

19. The pump system of claim 15, wherein the first and second tube guides are standalone structures.

* * * * *